US007462139B2

(12) United States Patent
Stafiej et al.

(10) Patent No.: US 7,462,139 B2
(45) Date of Patent: Dec. 9, 2008

(54) SKI EXERCISING AND REHABILITATION APPARATUS

(75) Inventors: Andrzej Stafiej, Sanok (PL); Ireneusz Rabczak, ul. Zacisze 3, Sanok (PL) 38-500; Jan Szostak, Sanok (PL); Jan Kozdraś, Zagorz (PL)

(73) Assignee: Ireneusz Rabczak, Sanok (PL)

( * ) Notice: Subject to any disclaimer, the term of this patent is extended or adjusted under 35 U.S.C. 154(b) by 867 days.

(21) Appl. No.: 10/478,105

(22) PCT Filed: Jun. 10, 2002

(86) PCT No.: PCT/PL02/00039

§ 371 (c)(1),
(2), (4) Date: Nov. 19, 2003

(87) PCT Pub. No.: WO02/100488

PCT Pub. Date: Dec. 19, 2002

(65) Prior Publication Data

US 2004/0152567 A1 Aug. 5, 2004

(30) Foreign Application Priority Data

Jun. 12, 2001 (PL) ..... 348084
Mar. 6, 2002 (PL) ..... 352640

(51) Int. Cl.
*A63B 21/00* (2006.01)
*A63B 22/00* (2006.01)

(52) U.S. Cl. ..... 482/70; 482/51; 482/54

(58) Field of Classification Search ..... 482/51, 482/54, 70, 71, 91, 110
See application file for complete search history.

(56) References Cited

U.S. PATENT DOCUMENTS 3,814,417 A 6/1974 Catlin
4,087,088 A 5/1978 Kelso (Continued)

FOREIGN PATENT DOCUMENTS

| | | | |
|---|---|---|---|
| EP | 0561493 | A1 | 9/1993 |
| FR | 1086010 | | 2/1955 |
| GB | 2152825 | A | 8/1985 |
| WO | 0130464 | A1 | 5/2001 |
| WO | 02060544 | A1 | 8/2002 |

OTHER PUBLICATIONS

PCT International Search Report, International Application No. PCT/PL 02/00039, pp. 1-4, Completion Date Dec. 2, 2002.

*Primary Examiner*—Glenn E. Richman
(74) *Attorney, Agent, or Firm*—John A. Merecki; Hoffman, Warnick, & D'Alessandro, LLC

(57) ABSTRACT

A ski-exercising and rehabilitation apparatus of the invention wherein the down-hill-run unit (22), has a system of rotatable rolls (25) mounted with bearings in external clamping beams (20) and (21) and in the central beam (26) so that their rotation axes lie in one arched plane, whereas said central beam (26) is supported on its ends with shock absorbers (27), whereas the ends of external clamping beams (20 and 21) are jointed at one end with the shorter articulated connecting rods (18 and 19) of variable lengths and at the other end with the longer articulated connecting rods (23 and 24) of variable lengths, the other ends of which are rotatably connected with respective discs of the gear wheels (13, 14, 15 and 16) mounted on the front drive shaft (11) and rear drive shaft (12), said external clamping beams (20 and 21) being also jointed to rocking levers (34 and 35) which are connected to actuators (36) mounted in the frame base (1) of the apparatus, whereas the light signs (54), imitating the positions of slalom poles, are located on the track mat (30) of said downhill-run unit (22) in form of bristled track mat banding arcwise the upper drive roll (32) and lower drive roll (31).

25 Claims, 5 Drawing Sheets

Figure 1:
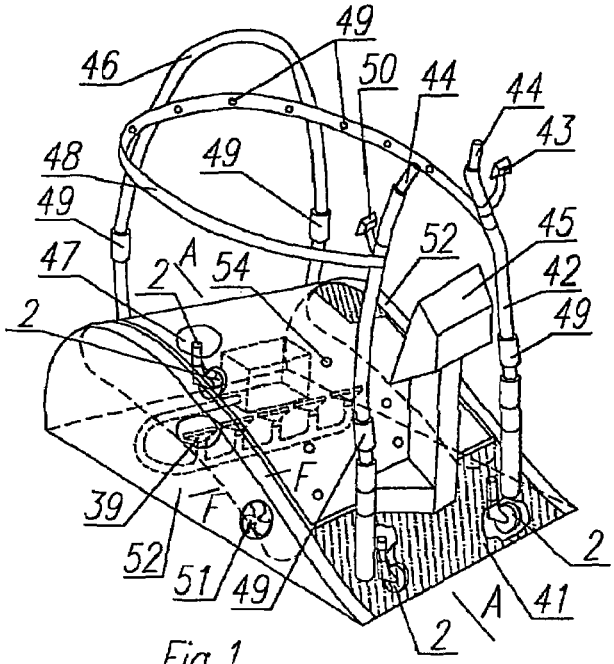

U.S. PATENT DOCUMENTS 4,423,864 A * 1/1984 Wiik ..... 472/91
5,226,866 A * 7/1993 Engel et al. ..... 482/70
5,643,153 A * 7/1997 Nylen et al. ..... 482/110
5,665,031 A * 9/1997 Hsieh ..... 482/54
5,833,584 A * 11/1998 Piaget et al. ..... 482/70

* cited by examiner

SKI EXERCISING AND REHABILITATION APPARATUS

The object of this invention is the apparatus for ski exercising and rehabilitation, intended to serve for both beginning and professional skiers as well as for persons rehabilitated, as it enables exercising of those muscle groups which work during an real downhill run and rehabilitation through massage of feet, imitation of downhill or cross-country run, etc. and an improvement of the apparatus according to additional patent application No. P-352640.

The ski exercising apparatus known from Polish patent application No. 181049 consists of a frame base the main plane of which is slanted at acute angle in respect to the lower plane, whereas a track mat, provided with a springing bristled mat and with running rolls, is located above the frame base and is connected rotatably with that base by means of a lever. Besides, the frame base contains a front drive shaft and rear drive shaft and a springing element stimulating a free movement of skis located between the deck and the main ski fixing element. This apparatus is also equipped with the drive unit consisting of electric motor, worm gear and belt transmissions transferring the drive onto the rear drive shaft and then to the front drive shaft and onto driving element of running rolls.

The drawback of the prior-art solution is its low universality, no possibility to use it with various types of ski equipment, for rehabilitation and, what is most important, to use it by beginning skiers, especially children, because the springing element stimulating free movement of skis restricts the free movement with skis and enforces constant concentration of the trainee on commanding the skis.

The objective of this invention is to design an apparatus, which shall enable the skiers a comprehensive exercising at different speeds, including running over uneven terrain of different heights, randomly varying during downhill runs, training for beginners, training on any type of skis, creating of skiing conditions on snow or icy surface, as well as for the rehabilitation of many human organs.

The essence of the apparatus for ski exercising and rehabilitation of the present invention consists in that it has a downhill-run unit containing a system of rotatable rolls with bearings in external clamping beams and in the central beam so that their rotation axes lie in one arched plane whereas the central beam is supported on its ends with shock absorbers while the ends of external clamping beams are jointed with shorter connecting rods and longer connecting rods of variable lengths the other ends of which are rotatably connected with respective discs of the gear wheels mounted on the front drive shaft and rear drive shaft.

Besides, the external clamping beams are jointed to rocking levers connected to actuators mounted in the frame base of the apparatus. In turn, light signs imitating the positions of slalom poles are located on the track mat of the downhill-run unit in form of a bristled track mat banding arcwise the upper drive roll and lower drive roll below, whereas the damping and cooling nozzles, connected with refrigerating unit, are located in the lower portion under the track mat while monitoring unit and the support poles with handles are mounted in the front part of the apparatus. At least one pole is provided with the control panel electrically connected with the main drive motor, with the drive motor of the upper or lower roll, with the refrigeration unit, with signal lights, monitoring unit, diagnostic apparatus with the control panel, air conditioner and actuators. Preferably the shaft of the drive motor constitutes one of the drive rolls, lower or upper one, and the support poles are connected to each other and to the bow with the safety belt provided with safety cut-out switches on its internal surface while the endless track mat has 5 cm long bristles.

The improved solution the apparatus for ski exercising and rehabilitation of the present invention is provided with the frequency converter electricity interconnected with the drive motor and, through a transmission, with the upper drive roll and/or lower drive roll, the frame base of the apparatus is provided with wheels, while the side guards of the base are provided with a flange at their upper edge, crosswise to the track mat. Preferably the drive unit of the downhill-run unit is provided with upper electro-drum banded together with the lower drive roll by the bristled track mat, upper and/or lower electro-drum banded by the bristled track mat. It is preferred also that a track slide plate of arcwise longitudinal cross-section similar to circular sector be located between external clamping beams and supported with shock-absorbers in each corner. Said plate is made of material with high resistance to frictional wear and has its upper surface, contacting the track mat, polished. Besides, the ends of external clamping beams and those of the central beam in this unit are jointed with actuators mounted in the lower part of its frame base and the track mat rims are provided from the bottom with guiding elements, which preferably have a cross-sectional trapeze shape, located in circumferential grooves of the same shape as the guiding elements, made at the ends of driving rolls and/or electro-drums or, when the external clamping beams have slot guides of arcwise contour on their inner surfaces in which the rims of the track mat are located. It is also preferred that the external clamping beams contain in bearings additional rotatable rolls, located on the outside of drive rolls and/or electro-drums, banded with endless carrier belt driven by said band whereas the diameters of the rotatable rolls are smaller than those of the driving rolls and/or of the electro-drums. Besides, in this apparatus the driving rolls and/or the electro-drums and/or additional rolls have cylindrical shapes, or else their ends have truncated cone shapes. Preferably, the apparatus of the invention is provided with skis the lower slide surface of which is made of antistatic material with high resistance to frictional wear, high temperatures, preferably of carbon fiber of Ni—Cr steel.

The basic advantage of the invention is its universality of application enabling the use of. carving, traditional (downhill), cross-country and water skis as well as snowboards. The apparatus may be used by both advanced ski trainees and beginners who wish to learn skiing. The apparatus may also be used for physical mobility rehabilitation of tarsal joints, massage of feet through acting on receptors in feet soles, stimulation of blood circulation, as well as cross-country running exercise at various upward and downward slopes. A person under rehabilitation may be subject to health diagnostic such as heart-rate and blood pressure measurement as well as to effort-related health assessment. The apparatus enables also the training of skiing through moguls of variable heights thus serving for training these muscle groups which are working in a real downhill skiing. The apparatus enables also a creation of winter conditions on the bristled tract mat by spraying water over it and then freezing it. Such cycle may be either continuous, variable or intermittent and thus to simulate the real conditions existing on mountain-side slope. It ensures also the safety of exercising because the safety belt restricts its field and, in case of exceeding it, which is tantamount to a loss of balance, safety cut-out switches switch the main and lower-roll drive motors off. The advantage of his invention is also a direct drive of one of the drive rolls, thus eliminating the need for using additional transmissions from the main drive motor. Besides the advantage of the invention is that a monitoring unit, installed on the stationary strip, visualizes the training on the apparatus synchronized with the virtual world on the screen of monitor and, due to this, one may choose a landscape in real terrain, e.g. skiing in Swiss Alps. The noise of trainee's skiing may also be heard. The training on bristled track mat and light signs on it is shown on the screen as skiing between poles. In this way the trainee may reproduce his/her skiing and check whether his/her exercise contained mistakes or errors. It creates a potential for conducting a slalom hall competition event with the use of the apparatus. One can also read the skiing speed and the mileage as well as show the real downhill ski route. Having independent drives of bristled track mat movement and the speed of the downhill-run unit, various changeable variants may be achieved during the exercise. It avoids the exercising monotony and permits correction of skiing mistakes and errors in a short time. All these advantages of the apparatus of the invention provide safety to the trainee, a feeling of skiing in real conditions without leaving home and without costly, unsafe and long lasting trips in the mountains in search for skiing courses.

Application of castor wheels in the apparatus according to the invention facilitates its placing into a desired location in a specific room whereas the providing of skiing track mat with side V-belts and their driving shafts or electro-drums with grooves of the same profile as the V-belts make the lateral traveling of the track mat impossible. Providing the side guards with flanges crosswise to the track mat, as well as providing the inner walls of external clamping beams with slot guides of arcwise contour also prevents the lateral traveling of the track mat. In turn, the equipping of external clamping bars of the downhill run unit with additional rolls enables banding of drive shafts and electro-drams with costly carrier belt and said rollers with bristled mat driven by said belt, which in turn enables a longer period of service of the carrier belt because in case of local wear of the bristles on the track mat only the much cheaper bristled track mat is subject to replacement.

The application of actuators and frequency converter in the down-hill-run unit drive system enabled elimination of hitherto used shorter and longer connecting rods of variable length as well as the worm gear and belt transmissions, whereas the application of slide plate permitted elimination of electrostatic charges and enabled a considerable lengthening of ski life, which used to be very short because of high temperature generated between ski surface and the track mat.

Figure 2:
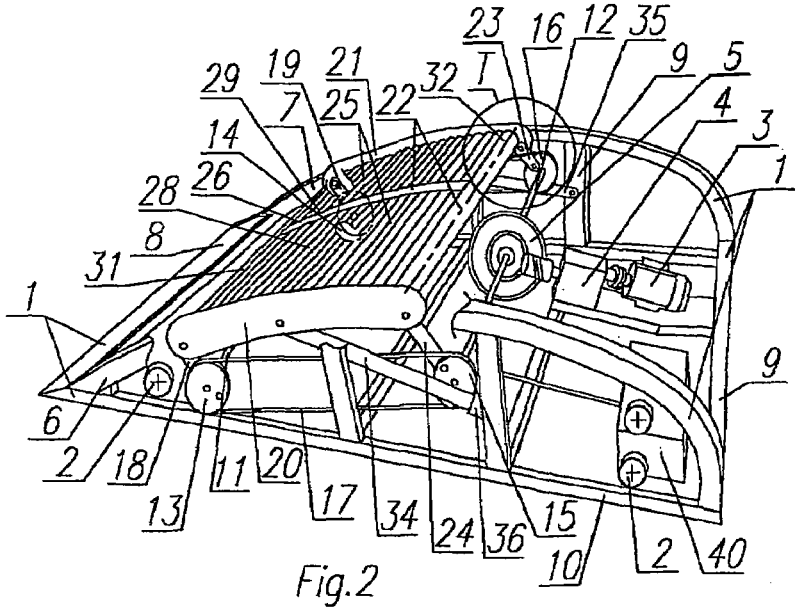
Figure 3:
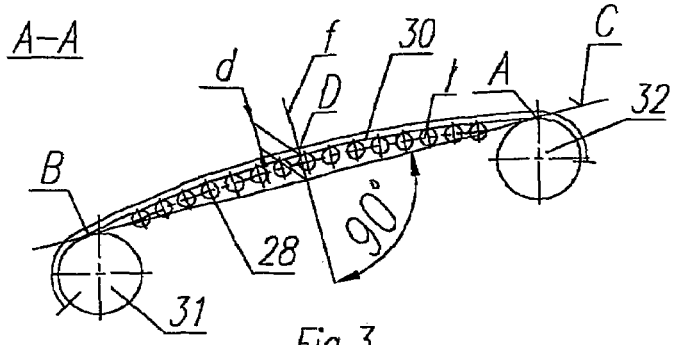
Figure 4:
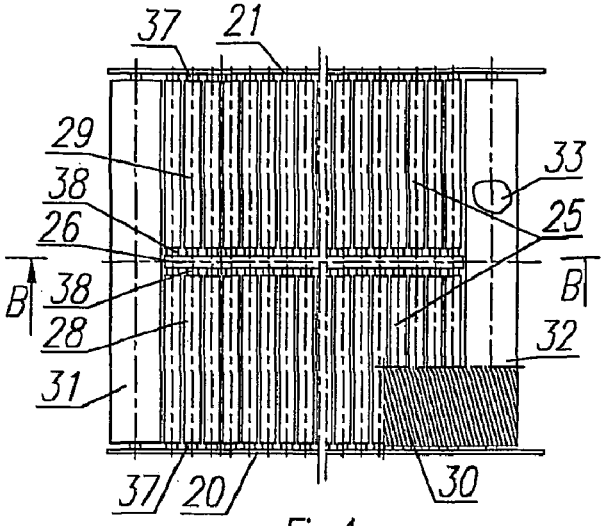
Figure 5:
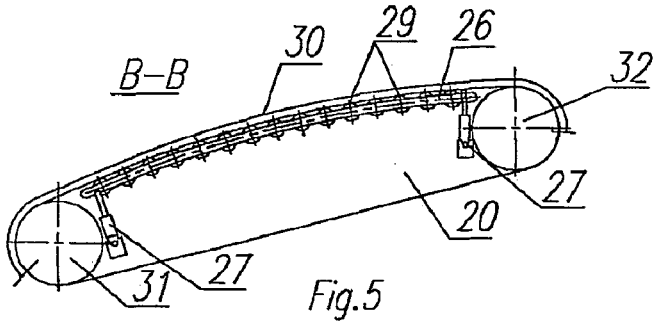
Figure 6:
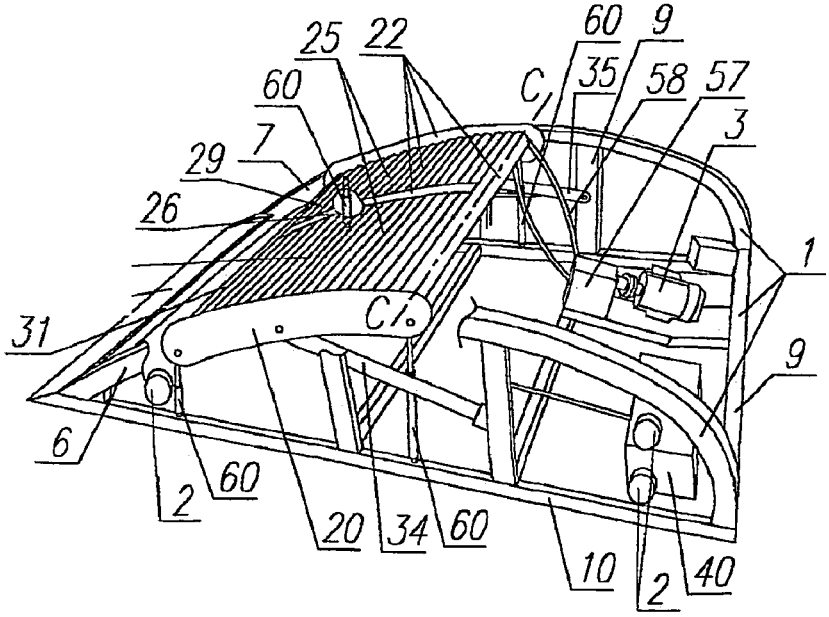
Figure 7:
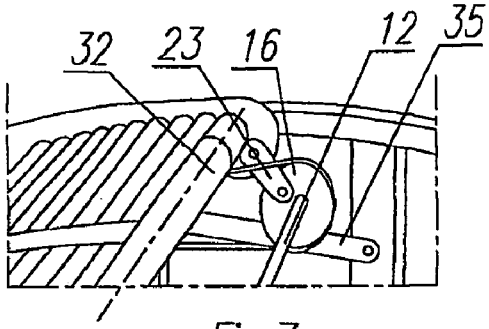
Figure 8:
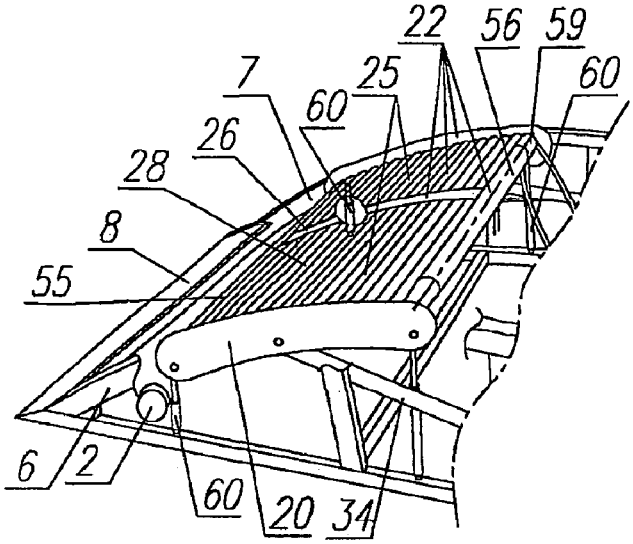
Figure 9:
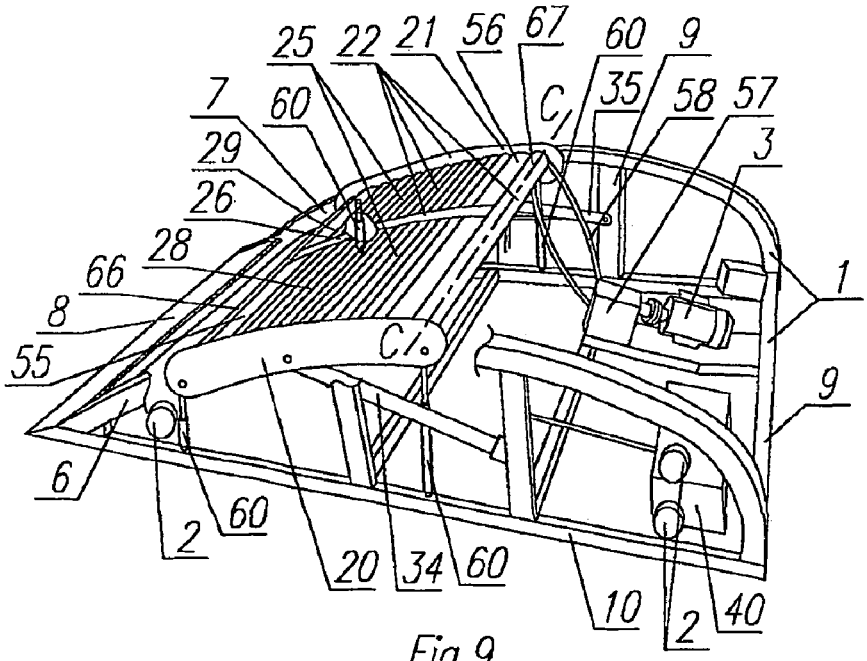
Figure 10:
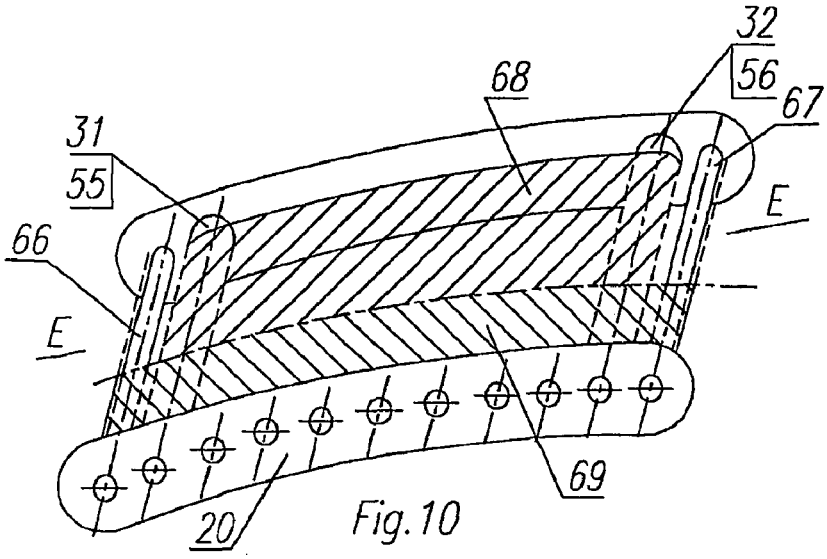
Figure 11:
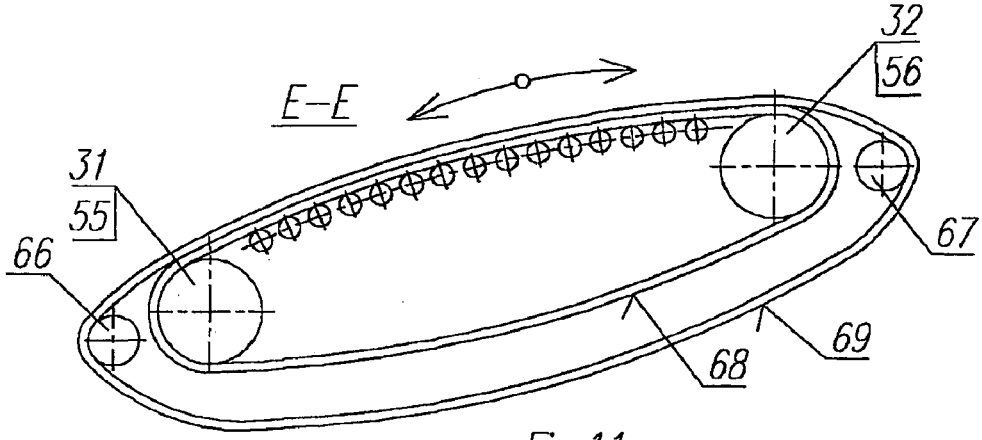
Figure 12:
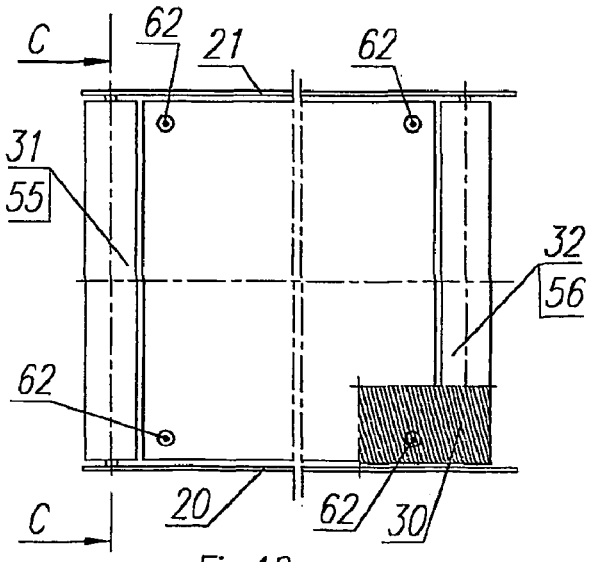
Figure 13:
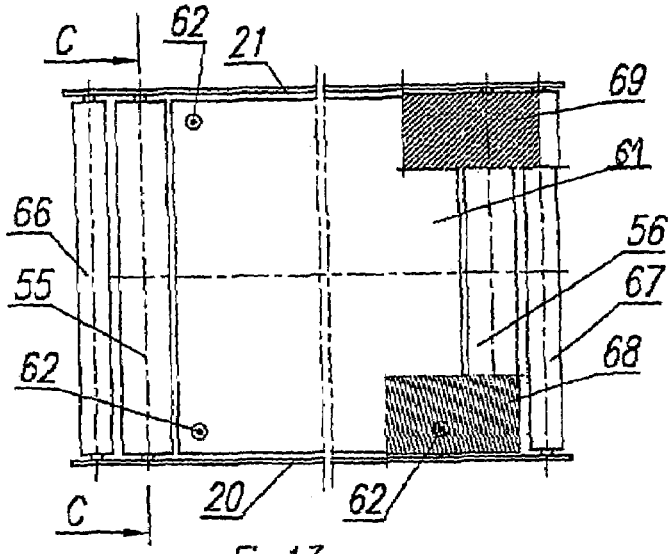
Figure 14:
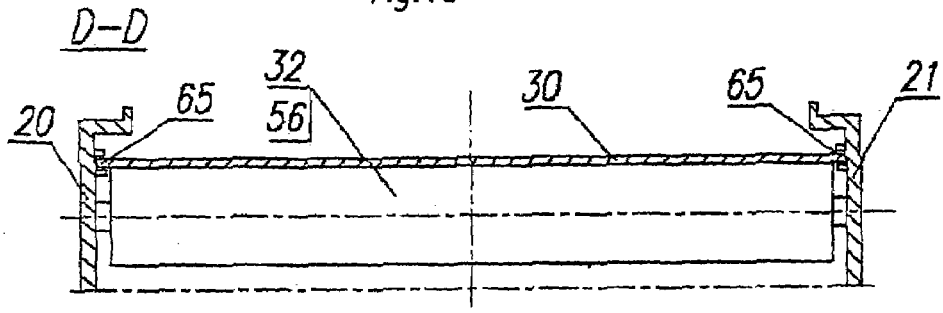
Figure 15:
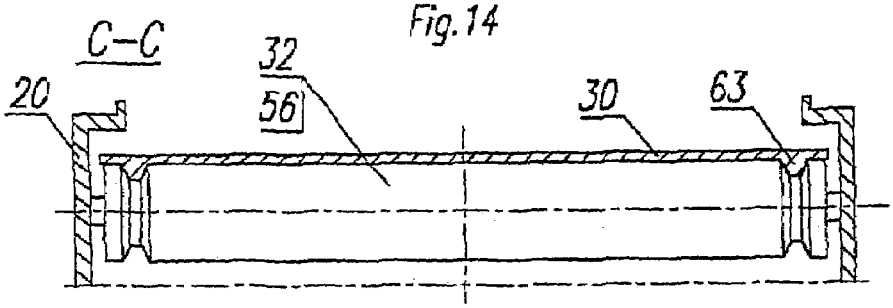
Figure 16:
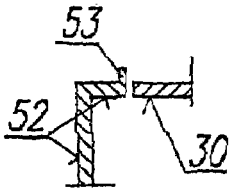

The invention is presented as the examples of embodiments in figures, where FIG. 1 is the axonometric projection of the apparatus with the frame base with its side guards, resting on castor wheels, with track mat, support poles, safety belt, monitoring unit and the air conditioner, FIG. 2 is the axonometric projection of the frame base of the apparatus with its drive unit and downhill-run unit after track-mat and side-guard removal, FIG. 3 is the cross section along the A-A line from FIG. 1 of the downhill-run unit with the track mat, FIG. 4 is the top view of the same downhill-run unit of the apparatus, FIG. 5 is the cross section along the B-B line from FIG. 4 of the same downhill-run unit of the apparatus, FIG. 6 is the axonometric projection of the frame base of the apparatus after track-mat and side-guard removal, with downhill-run unit provided with actuators, drive shafts or cylindrical electro-drums and the drive unit provided with frequency converter, FIG. 7 is the axonometric projection of the fragment "T" from FIG. 2 of the downhill-run unit provided with drive shafts or cylindrical-and-conical electro-drums, FIG. 8 is the axonometric projection of the frame base of the apparatus after track-mat and side-guard removal, with downhill-run unit provided with actuators, cylindrical-and-conical drive shafts as well as the drive unit with frequency converter, FIG. 9 is the axonometric projection of the same frame base of the apparatus with the downhill-run unit the external clamping beams of which are provided with drive shafts or electro-drums and with additional rotatable rolls in external bearings, FIG. 10 is the top view of the fragment of the downhill-run unit from FIG. 9, FIG. 11 is the cross section along the E-E line from FIG. 10 of the downhill-run unit of the apparatus with the track mat, FIG. 12 is the top view of the fragment of the downhill-run unit provided with drive shafts or electro-drums and the with slide plate between them, FIG. 13 is the top view of the fragment of the downhill-run unit provided with drive shafts or electro-drums as well as with additional rotatable rolls and the slide plate between them, FIG. 14 is the cross section along the C-C line from FIG. 6 of the fragment of downhill-run unit with the slot guide of its track mat, FIG. 15 is the cross section along the D-D line from FIG. 9 of the fragment of downhill-run unit with the trapeze guide of its track mat and FIG. 16 is the cross section along the F-F line from FIG. 1 of the fragment of the apparatus.

The apparatus of this invention consists of the frame base 1, resting on castor wheels 2, provided with a brake with the main drive motor 3, mounted in said frame base, connected through reducing gear 4 with the worm gear 5. The frame base 1 is formed by the upper arcwise and slanted side frame beams 6 and 7, with their arc convexity upward. Besides, the frame base 1 has bottom cross bars 8, supportive vertical beams 9 and bottom side beams 10. The lower part of the frame base contains in bearings the front and rear drive shafts, 11 and 12, respectively, driven with the main drive shaft 3. Driving chain wheels, 13 and 14, are mounted on one and the other ends of the front drive 11 and driving chain wheels, 15 and 16, are mounted on one and the other ends of the rear drive shaft 12. Driving chain wheels, 13, 14, 15 and 16 have the same diameters and constitute chain transmissions with chains 17. Ends of shorter connecting rods 18 and 19 of variable length are pivoted to chain disks of the driving chain wheels, 13 and 14, mounted on front drive shaft 11, whereas their other ends are pivoted to external clamping beams 20 and 21 of the downhill-run unit 22. On the other hand, the ends of longer connecting rods 23 and 24 of variable length are pivoted to driving chain disks of driving chain wheels, 15 and 16 mounted on the rear drive shaft 12, whereas their other ends are pivoted to external clamping beams 20 and 21 of the downhill-run unit 22. The downhill-run unit 22 has a system of rotatable rolls 25 with bearings in external clamping beams 20 and 21 as well as in the central beam 26 supported at its ends by shock absorbers 27. The central beam 26 is located between two rows of rotatable rolls 28 and 29 constituting a system of rotatable rolls 25. The downhill-run unit 22 is also provided with endless track mat 30 with 3-cm long bristles as well as with lower drive roll 31 and upper drive roll 32, constituted by the rotor shaft of drive motor 33. Besides, the external clamping beams 20 and 21 are jointed with rocking levers 34 and 35 coupled with actuators 36 mounted in frame base 1. The rotatable rolls 28 and 29 have smaller diameters than the upper and lower drive rolls, 32 and 31, with external pivots 37 are arranged along the arc in external clamping beams 20 and 21, while their internal pivots 38 are arranged along the similar arc in the central beam 26. The endless bristled track mat 30 is installed on the upper and lower drive rolls, 32 and 31, and supported by with rotatable rolls 28 and 29, thus forming a surface with arcwise contour. Preferably the section "d", formed between the straight line "c", joining the contact points of the endless bristled track-mat 30 with the upper and lower drive rolls, 32 and 31, and the contact surface of said track mat with the rotatable rolls 28 and 29 in the highest point "D" of the track-to-roll contact located on the line "f" perpendicular to the straight line "c", is 4 cm. Such location of the endless bristled track mat 30 and rotatable rolls 28 and 29 enables the training with any type of ski equipment.

There are wetting and cooling nozzles 39 arranged all through the width of the endless bristled track mat 30 and connected with the refrigerating unit 40. They first supply water onto the surface of this track mat and then freeze it.

A monitoring unit 45, located in the front part of the stationary strip 41 between the support poles with control panel 43 at the handle 44 and breaker switches, synchronized with the functioning of the entire apparatus, wherefrom the skiing speed and the number of kilometers passed may be red. The screen of said unit may visualize the real downhill-run route in the terrain. In turn, a rigid safety belt 48 is fixed to one support pole 42, to bow 46 located on the rear guard 47 and to the other pole 42, whereas both the bow 46 and the rigid safety belt 48 and support pole 42, are provided with safety cut-out switches 49 enabling total stop of motion of the downhill-run unit in case the trainee has exceeded his/her field of maneuver. The apparatus is also equipped with the diagnostic unit for the trainee with control panel 50 installed on the support pole 42 as well as air conditioner 51 located in the lower part of the apparatus. The side beams 6, 7 and 10 of the frame base 1 are covered by side guards 52 which have flanges 53 on their internal peripheries crosswise to the endless bristled track mat 30. There are light signals 54 simulating the positions of slalom track poles on the endless bristled track mat 30.

In other examples of execution of this invention (FIGS. 6, 8 and 9) instead of drive rolls 31 and 32 mounted on the ends of external clamping beams 20 and 21 of the downhill-run unit 22, there are the lower electro-drum 55 and upper electro-drum 56 or upper electro-drum 56 and the lower drive roll 31 or lower electro-drum 55 and the lower drive roll 32, whereas said electro-drums, or electro-drum with respective roll, are banded by the endless bristled track mat 30.

In the subsequent examples of execution of this apparatus (FIGS. 6 and 9) its driving unit is provided with frequency converter 57 installed in the lower part of the frame base 1, electrically connected with the main drive motor 3 as well as, through a belt transmission 58, with the upper drive roil 32 or lower drive rod 31.

In the subsequent examples of execution the ends of drive rolls 31 and 32 and electro-drums 55 and 56 of the downhill-run unit 22 have the shape of truncated cones 59, whereas the ends of external clamping beams 20 and 21 and the central beam 26 of said unit are jointed with actuators 60 installed in the lower part of the frame base 1 (FIGS. 6-9).

In the other example of execution, presented in FIG. 12 and 13, the slide plate 61 for the endless bristled track mat 30 is located between external clamping beams 20 and 21 of the downhill-run unit 22 and drive rolls 31 and 32 or electro-drums 55 and 56 and is supported with shock absorbers 62 in each corner. Said slide plate 61 is made of chromium nickel steel, has elongated arcwise shape similar to circular sector and its upper surface contacting the endless bristled track mat 30 is polished.

In a further example of execution (FIGS. 12, 13 and 15) the rims of the endless bristled track mat 30 are provided at its back side with V-belts 63, located and guided in the circumferential grooves 64 of the same profile as the V-belts 63 made at ends of drive rolls 31 and 32 and/or electro-drums 55 and 56.

In the other example of execution (FIGS. 9 and 14) the external clamping beams 20 and 21 of the downhill run unit 22 have slot guides 65 of arcwise outline on their internal surfaces which take in the rims of the endless bristled track mat 30.

In a further example of execution of the apparatus of the invention (FIGS. 10 and 11) the external clamping beams 20 and 21 of the downhill-run unit 22 contain in bearings additional rotatable rolls 66 and 67 located on the outside of the driving rolls 31 and 32 and/or electro-drums 55 and 56 whereas the driving rolls, 31 and 32 and/or the electro-drums, 55 or 56 are banded with endless carrier belt 68 whereas the additional rotatable rolls 66 and 67 are banded with endless bristled track mat 69 driven with carrier belt 68, whereas the diameters of rotatable rolls 66 and 67 are smaller Man those of the drive rolls 31 and 32 and/or electro-drums 55 and 56.

The apparatus of the invention executed in all above described versions is equipped with skis the bottom slide surface of which is made of carbon fiber, whereas in the other embodiment said surface is made of chrome-nickel steel.

The functions of the apparatus are realized in two basic variants: the trainee, positioned on the endless bristled track mat 30, uses the control panel to switch ON the main drive motor 3 and adjusts its slope, then he/she starts the drive motor 33 of the upper drive roll 32 which moves the endless bristled track mat 30 and said mat, in turn, puts into motion a system of rotatable rolls 25 and the lower drive roll 31 The trainee holds the grip handles 44 of support poles 42, begins exercising while performing various maneuvers and motions as are done during downhill skiing. He/she may train slalom skiing because the endless bristled track mat 30 is provided with light signs 54 for such skiing. Without skis, the trainee may run upward or downward, in shoes or without, and perform various rehabilitation exercises, while selecting the slope and speed of the endless bristled track mat 30 to suit his/her weight.

For beginners, especially children, an additional horizontal support bar, not shown on the drawing, may be fixed between the support poles 42. The trainee, while holding it, may concentrate on arranging and lifting of skis, thus getting accustomed to downhill skiing. The apparatus may be used for training of water skiers. For that, the motor 33 is run in a reverse sense of drive rotation. The trainee may watch entire course of his/her maneuvers, and the distance (kilometers) passed, on the screen of the monitoring unit 45 and check what and where mistakes has been made.

In case of training the skiing over moguls the trainee uses the control panel 43 to start the main variable-speed drive motor 3 on which drives the reduction gear 4, worm gear 5 and rear drive shaft 12, chain drive wheels 15 and 16 and then chains 17 and drive wheels 13 and 14 transmit the drive to the front drive shaft 11.

Then, from chain wheels 13-16, through shorter connecting rods 18 and 19 and longer connecting rods 23 and 24 of variable length, as well as rocking levers 34 and 35, the downhill-run unit 22 is put into shifting and self-aligning motion, thus enforcing the skiing over moguls. The drive motor 33 is also ON and the endless bristled track mat 30 moves in a mode that can be varied during training. Also, during training, the speed of the main drive motor 3 can be varied, the lengths of shorter connecting rods, 18 and 19 as well as 23 and 24, and those of rocking levers 34 and 35, can be changed as well.

As a result, a number of skiing combinations are achievable for the trainee and training satisfaction while the exercising monotony is limited to minimum. The monitoring unit 45 enables reading of skiing speed, and the distance (kilometers) passed in specific time, on the screen. Bow 46 and a rigid safety belt 48 joining the bow with support poles 42, protect the trainee against balance-loss threatening positions of the body, whereas the safety cut-out switches 49 protect the trainee in case of exceeding the motion field on the endless bristled track mat 30. Then, each touch of the rigid safety belt 48 with trainee's body or positioning it in the line of the light (sender-receiver) signal of the specific cut-out switch shall stop of the apparatus. In both variants the trainee may have the skiing approximated to winter conditions by switching ON the refrigeration unit 40. Through damping and cooling nozzles 39 said unit will freeze water all over the external surface of the endless bristled track mat 30 and will maintain during training any state of the surface similar to skiing over a snow-covered slope. The control panel 50 and the diagnostic unit connected to it enables also reading the health state of the trainee—his/her blood pressure, heart rate. Also, on starting the air-conditioning unit 51 air is blown onto the trainee thus providing a feeling of skiing in free air, whereas during skiing over moguls the rotatable rolls 28 and 29 yield, together with the central beam 26, and then the trainee sags onto the endless bristled track mat 30. In case of using the electro-drums 55 and 56 of actuators 60, frequency converter 57, additional rotatable rolls 66 and 67 as well as the slide plate 61 the principle of operation of the apparatus in analogical to that described above.

What is claimed is:

1. A ski-exercising and rehabilitation apparatus comprising:

(a) frame having a substantially rectilinear base having two sides, a forward end and a rearward end, and two side members attached to the base at first and second attachment points proximate to the forward and rearward ends of the base respectively, the side members each defining a convex arcuate upper profile from the forward and rearward ends to an apex;

(b) a downhill-run unit supported by the frame and comprising:

(i) a first and a second external clamping beam substantially longitudinally parallel and each having first and second ends;

(ii) an upper drive roll connected to the first and second external clamping beams at their respective first ends;

(iii) a lower drive roll connected to the first and second external clamping beams at their second ends;

(iv) a central beam located between and substantially parallel to the first and second external clamping beams, the central beam having a first central beam end and a second central beam end, the central beam ends being supportably connected to respective first and second shock absorbers;

(v) a plurality of rotatable rolls each mounted in bearings in the central beam and one of the first and second external clamping beams;

(vi) a drive means comprising at least one motor;

(vii) rocking means operatively connecting each of the external clamping beams to the drive means;

(viii) actuator means operatively connecting each of the external clamping beams to the frame; and (ix) a track mat having a bristled upper surface and being supported by the upper and lower drive rolls and at least some of the rotatable rolls, and having light sign means provided to the bristled upper surface.

2. The ski-exercising and rehabilitation apparatus according to claim 1, wherein the drive means further comprises:

(a) four gear wheels, each one being operatively connected to a selected one end of each of the upper and lower drive rolls;

(b) a first pair of articulated connecting rods each attached to one of the first ends of the external clamping beams and to an adjacent one of the gear wheels;

(c) a second pair of articulated connecting rods each longer than the first pair, and each attached to one of the second ends of the external clamping beams and to an adjacent one of the gear wheels; and the actuator means is further selectively operatively connected to the rocker means.

3. The ski-exercising and rehabilitation apparatus according to claim 1, wherein the downhill-run unit further comprises:

(x) a refrigeration unit located below the track mat;

(xi) a damping nozzle and a cooling nozzle each operatively coupled to the refrigeration unit.

4. The ski-exercising and rehabilitation apparatus according to claim 1, further comprising a monitoring unit and a pair of support poles each having a handle, the monitoring unit and the pair of support poles being mounted on the frame proximate the forward end of the frame, one of the support poles comprising a control panel having a diagnostic apparatus operatively coupled to the drive means, the refrigeration unit, the light sign means, the monitoring unit, and the actuating means.

5. The ski-exercising and rehabilitation apparatus according to claim 4, wherein the support poles are connected to each other and to a bow with a safety belt having at least one safety-cutout switch on an inner surface thereof.

6. The ski-exercising and rehabilitation apparatus according to claim 1, wherein the bristles of the track mat have a height of 5 cm.

7. The ski-exercising and rehabilitation apparatus according to claim 1, wherein the drive means comprises:

a frequency converter electrically interconnected with the at least one motor;

a transmission means operatively coupled to the frequency converter and to at least one of the upper drive roll and the lower drive roll.

8. The ski-exercising and rehabilitation apparatus according to claim 1, wherein the forward and rearward end of the frame each comprise at least one wheel.

9. The ski-exercising and rehabilitation apparatus according to claim 8, wherein each of the side members of the frame comprises a flange extending transversely to the side member proximate the rearward end of the frame.

10. The ski-exercising and rehabilitation apparatus according to claim 1, wherein at least one of the upper and the lower drive rolls is an electro-drum and the upper and lower drive rolls are operatively banded together by the mat.

11. The ski-exercising and rehabilitation apparatus according to claim 10, wherein the drive means comprises:

(a) a frequency converter electrically interconnected with the at least one motor;

(b) a transmission means operatively coupled to the frequency converter and to at least one of the upper drive roll and the lower drive roll.

12. The ski-exercising and rehabilitation apparatus according to claim 1, wherein the downhill-run unit further comprises (a) a slide plate located between the first and second external clamping beams and the upper and lower drive rolls, the slide plate being substantially rectangular and having an upper surface configured to correspond to the profile of an upper surface of the first and second external clamping beams; and (b) a plurality of shock absorbers constructed and arranged to support a lower surface of the slide plate proximate corners of the slide plate.

13. The ski-exercising and rehabilitation apparatus according to claim 12, wherein the slide plate is made of chromium nickel steel.

14. The ski-exercising and rehabilitation apparatus according to claim 13, wherein the upper surface of the slide plate is polished.

15. The ski-exercising and rehabilitation apparatus according to claim 1, wherein a lower surface of the track mat comprises a pair of rims each having a guiding element, wherein the upper and lower drive rolls each comprise a circumferential groove having a profile that corresponds to the profile of each guiding element.

16. The ski-exercising and rehabilitation apparatus according to claim 15, wherein the guiding elements are substantially trapezoidal in cross-section.

17. The ski-exercising and rehabilitation apparatus according to claim 1, wherein (a) a lower surface of the track mat comprise a pair of rims, and (b) an inner surface of the first and second external clamping beams each have a slot guide of arcwise contour constructed and arranged to engage with each of the rims.

18. The ski-exercising and rehabilitation apparatus according to claim 1, wherein the downhill-run unit further comprises:

(a) a secondary upper drive roll connected to the first and second external clamping beams at their respective first ends, substantially parallel to the upper drive rolls;

(b) a secondary lower drive roll connected to the first and second external clamping beams at their respective second ends, substantially parallel to the lower drive rolls; and (c) an endless carrier belt supported by the secondary upper drive roll and the secondary lower drive roll;

wherein the upper and lower drive rolls are each closer than the respective secondary upper and lower drive rolls to a midpoint of the first and second external clamping beams and the secondary upper drive roll and the secondary lower drive roll each have a diameter less than a diameter of each of the upper and lower rolls.

19. The ski-exercising and rehabilitation apparatus according to claim 1, wherein the upper and lower drive rolls are of cylindrical shape.

20. The ski-exercising and rehabilitation apparatus according to claim 10, wherein the upper and lower drive rolls are of cylindrical shape.

21. The ski-exercising and rehabilitation apparatus according to claim 17, wherein the upper drive roll, the lower drive rolls, the secondary upper drive roll and the secondary lower drive roll are of cylindrical shape.

22. The ski-exercising and rehabilitation apparatus according to claim 1, wherein each end of each of the upper drive roll and the lower drive roll has a truncated cone shape.

23. The ski-exercising and rehabilitation apparatus according to claim 17, wherein each end of each of the secondary upper drive roll and the secondary lower drive roll has a truncated cone shape.

24. The ski-exercising and rehabilitation apparatus according to claim 1, further comprising a pair of skis having a lower slide surface made of antistatic material with high resistant to frictional wear and high temperatures.

25. The ski-exercising and rehabilitation apparatus according to claim 24, wherein the lower slide surface of the skis is made of carbon fibre of Ni—Cr steel.

* * * * *